US006758407B1

(12) United States Patent
Lambert et al.

(10) Patent No.: US 6,758,407 B1
(45) Date of Patent: Jul. 6, 2004

(54) FUEL INJECTOR

(75) Inventors: Malcolm David Dick Lambert, Bromley (GB); Simon David Tullis, Gillingham (GB); Godfrey Greeves, Hatch End (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/590,707

(22) Filed: Jun. 8, 2000

(30) Foreign Application Priority Data

Jun. 9, 1999 (GB) ..... 9913314

(51) Int. Cl.[7] ..... F02D 1/06

(52) U.S. Cl. ..... 239/5; 239/433; 239/533.3; 239/533.12; 239/543; 239/544; 239/584; 123/294; 123/296; 123/305

(58) Field of Search ..... 239/418, 433, 239/533.12, 533.3, 533.4, 533.8, 533.9, 533.11, 583, 584, 585.1, 585.5, 543, 544, 5; 123/294, 296, 299, 305

(56) References Cited

U.S. PATENT DOCUMENTS 4,202,500 A * 5/1980 Keiczek ..... 239/533.3
4,546,739 A * 10/1985 Nakajima et al. .... 239/533.4 X
4,570,853 A * 2/1986 Schmied ..... 239/533.3 X
5,540,200 A * 7/1996 Naitoh et al. ..... 239/544
5,899,389 A 5/1999 Pataki et al.
6,220,528 B1 * 4/2001 Cooke et al. ..... 239/533.3

FOREIGN PATENT DOCUMENTS

| | | |
|---|---|---|
| EP | 0 967 382 A2 | 12/1999 |
| GB | 1-293 088 | 10/1972 |
| WO | 87/06308 | 10/1987 |

* cited by examiner

*Primary Examiner*—Steven J. Ganey
(74) *Attorney, Agent, or Firm*—Jimmy L. Funke

(57) ABSTRACT

A fuel injector comprising a nozzle body, a first outlet opening having an axis, a second outlet opening having an axis, and means for controlling fuel delivery through the first and second outlet openings. The axes of the first and second outlet openings are arranged so as to intersect one another downstream of the outlet openings such that, when fuel is delivered through both the first and second outlet openings, a combined spray formation is formed which is substantially equivalent to a single spray formation having been delivered from a single opening.

12 Claims, 4 Drawing Sheets

FUEL INJECTOR

This invention relates to a fuel injector for use in delivering fuel under high pressure to a combustion space of an engine. The invention relates, in particular, to an injector of the type having a plurality of axially spaced outlet openings or rows of outlet openings and means for controlling the number of openings or rows of outlet openings through which fuel is to be delivered.

FIG. 1 illustrates part of a known fuel injector which includes an outer valve needle 1 which is guided for sliding movement within a blind bore 2 provided in a nozzle body 3. The bore 2 defines a seating with which the needle 1 is engageable to control the fuel supply to a first outlet opening 4. Although only a single opening 4 is illustrated, a row of such openings may be provided, the openings being located at the same axial position relative to the bore 2.

The needle 1 is provided with the blind bore 5 within which an inner needle 6 is reciprocable. The inner end of the inner needle 6 is of enlarged diameter and is engageable with a step or shoulder defined by the inner end of a tubular sleeve 7 located within the bore 5. The sleeve 7 is arranged such that, once the outer needle 1 has moved away from the seating by a predetermined distance, further movement is transmitted to the inner needle 6 to lift the inner needle 6 away from the seating and allow fuel delivery through a second outlet opening 8 or group of such openings. A suitable control arrangement is provided to control the distance through which the outer needle 1 moves, in use.

It will be appreciated that by appropriately controlling the injector, fuel can be delivered either through the first opening or openings 4 alone or through both the first and second openings 4, 8. It is desirable to provide a fuel injector in which, in all modes of operation, the injector operates as if fuel is being delivered through a single outlet opening or row of openings. Clearly, in the known arrangement this is not achieved as, in one mode of operation, fuel delivery is occurring through two openings or groups of openings.

By way of background to the present invention, U.S. Pat. No. 5,540,200 describes a fuel injection valve for a gasoline engine in which the fuel sprays from different openings provided in a nozzle body are collided to cause atomisation of the fuel as a result of a resonance phenomenon.

According to the present invention there is provided a fuel injector comprising a nozzle body, a first outlet opening, a second outlet opening, and means for controlling fuel delivery through the first and second outlet openings, wherein the axes of the first and second outlet openings intersect one another downstream of the outlet openings. The axes of the first and second outlet openings are arranged such that, when fuel is delivered through both the first and second outlet openings, a combined spray formation is formed which is substantially equivalent to a single spray formation having been delivered from a single opening. The means for controlling fuel delivery through the first and second outlet openings are arranged to permit fuel delivery from only one of the outlet openings.

The fuel injector permits the fuel mass flow and the fuel momentum mass flow into a single spray to be varied by merging the fuel sprays from both the first and second outlet openings, with each of the first and second outlet openings normally adopting a fully open or fully closed state. This avoids the undesireable spray formation which can occur in other designs of variable area nozzle injectors where the amount by which an outlet opening is uncovered is used to vary the fuel flow into each fuel spray formation.

By arranging for the axes of the openings to intersect, when fuel is delivered through both outlet openings at the same time the sprays impinge upon and interfere with one another to form a single combined spray formation. Injection of a combined spray formation into the combustion chamber of the associated engine improves engine emissions and combustion noise performance.

Preferably, the first and second outlet openings are arranged so as to give rise to a combined spray formation which is substantially equivalent to a single spray formation having been delivered from an outlet opening having a diameter greater than that of the first outlet opening.

The combined spray formation has an associated axis and, preferably, the angle between the axis of the first outlet opening and the axis of the combined spray formation has a value falling within the range +7.5° to −7.5°. The angle between the axis of the second outlet opening and the axis of the combined spray formation also preferably has a value falling within the range +7.5° to −7.5°. It has been found that by arranging the axes in this way, optimum emission levels and combustion noise levels are achieved over a range of engine speeds and loads.

The first and second openings conveniently open into a bore provided in the nozzle body at axially spaced positions. The means for controlling fuel delivery through the first and second outlet openings may comprise an outer needle slidable within the bore to control fuel delivery through the first opening and an inner needle slidable within a bore formed in the outer needle to control fuel delivery through the second outlet opening. Load transmitting means may be provided to transmit movement of the out needle beyond a predetermined position to the inner needle.

One or more additional pairs of first and second openings may be provided. Further openings, for example aligned with the second opening, may be provided if desired.

The invention will further be described, by way of example, with reference to the accompanying drawings, in which.

Figure 1:
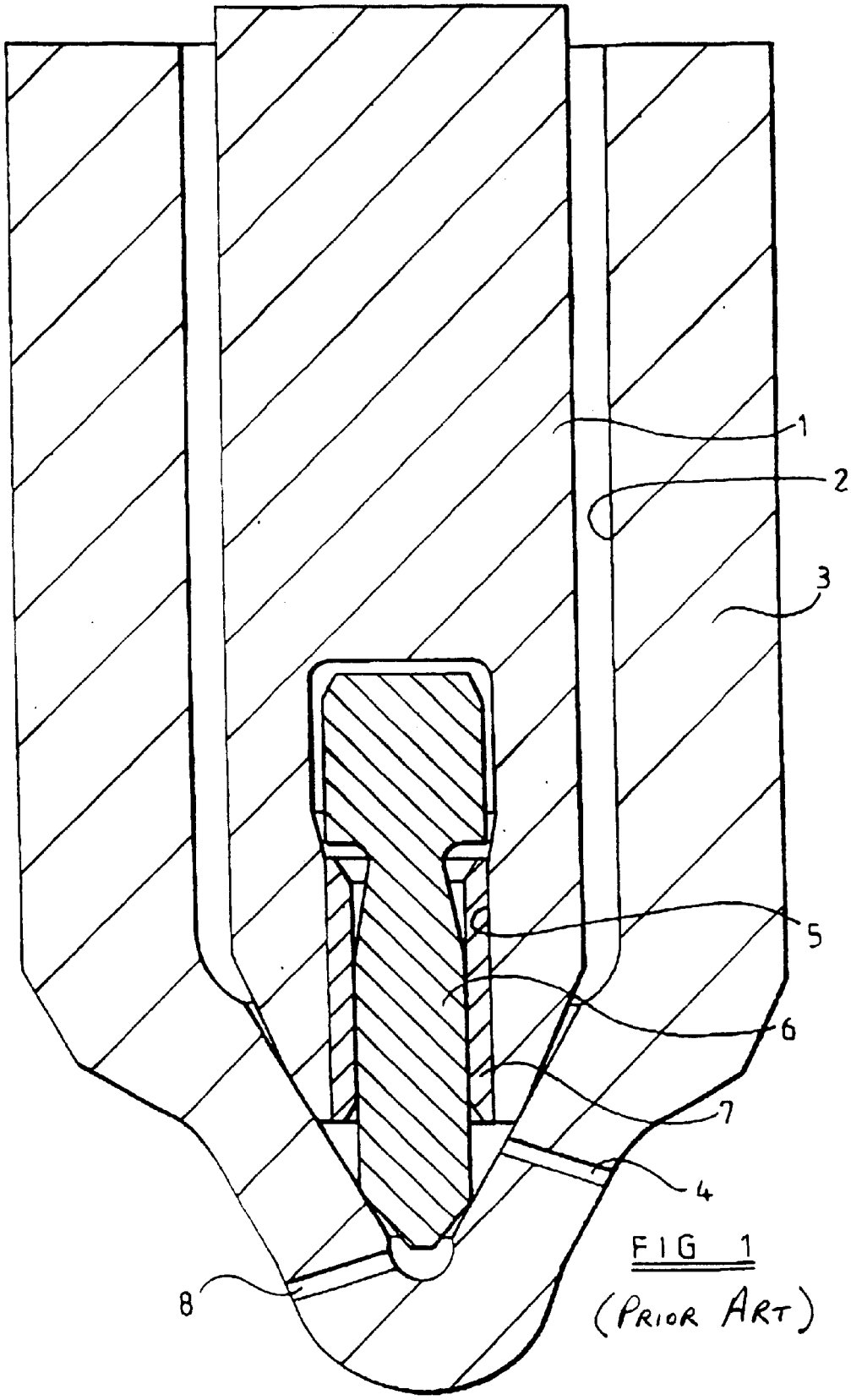
FIG 1 (PRIOR ART)
FIG. 1 is a sectional view of part of a known fuel injector.
Figure 2:
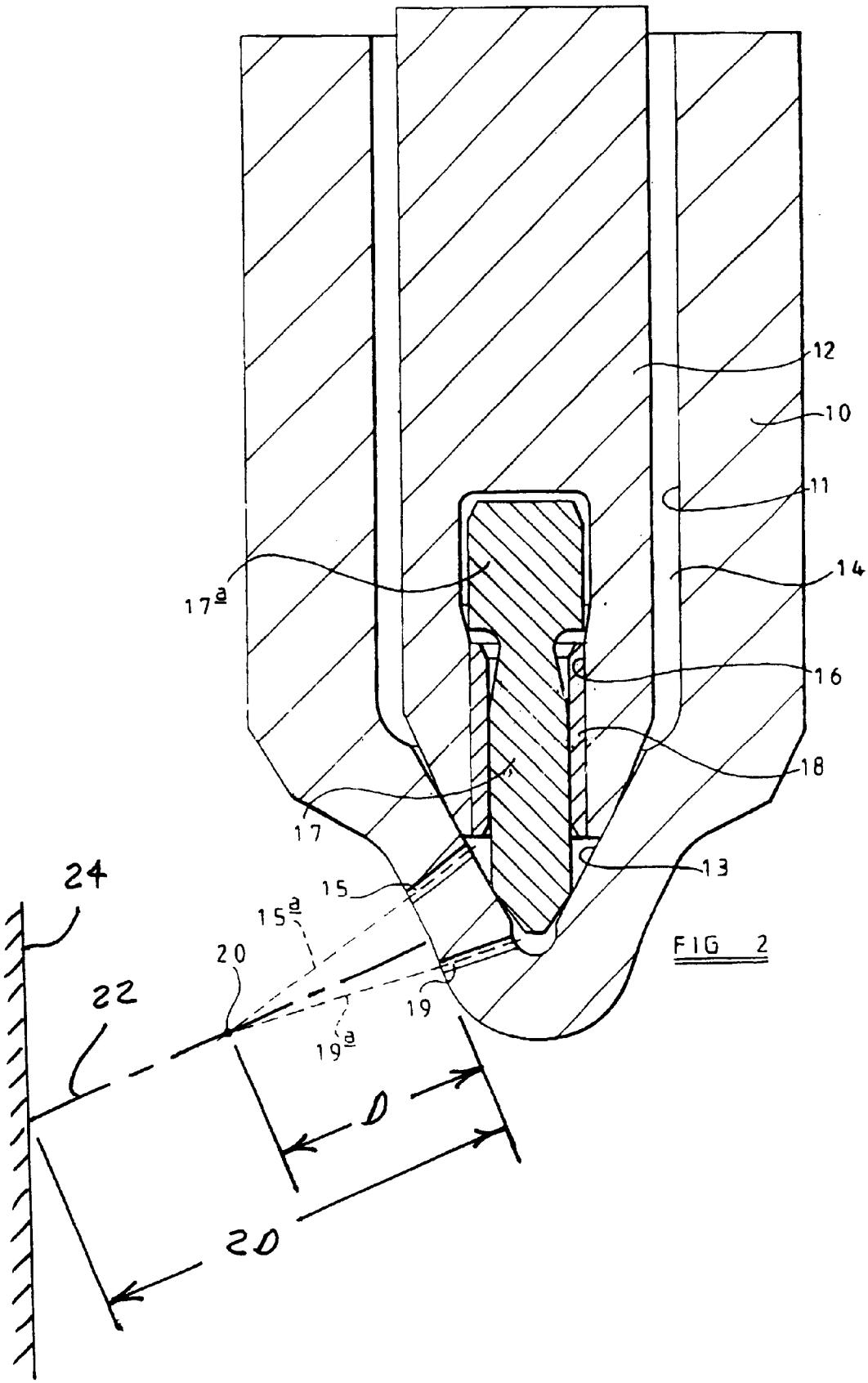
FIG. 2 is a view similar to FIG. 1 illustrating an injector in accordance with an embodiment of the invention.

The fuel injector illustrated, in part, in FIG. 2 comprises a nozzle body 10 having a blind bore 11 formed therein. An outer valve needle 12 is slidable within the bore 11, the needle 12 having a region (not illustrated) dimensioned to guide the needle 12 for sliding movement within the bore 11. The needle 12 includes, at one end, a frusto-conical surface which is shaped for engagement with a seating surface 13 defined adjacent a blind end of the bore 11 to control communication between a delivery chamber 14 defined between the nozzle body 10 and the needle 12 and a chamber which communicates with a first outlet opening 15.

The needle 12 is provided with a blind bore 16 within which an inner valve needle 17 is located. The inner valve needle 17 includes an enlarged head 17*a* which is shaped to be cooperable with a shoulder, defined by an inner end of a tubular sleeve 18 which is located within the bore 16, holding the inner valve needle 17 captive relative to the outer valve needle 12 and restricting the distance through which the inner valve needle 17 can move relative to the outer valve needle 12. The inner valve needle 17 is engageable with the seating surface 13 to control fuel delivery to a second outlet opening 19.

The first outlet opening 15 extends along an axis 15*a*. Similarly, the second outlet opening 19 extends along an axis 19*a*. The first and second outlet openings 15, 19 are located and orientated such that their axes 15*a*, 19*a* intersect externally of the injector at a point 20.

In use, the delivery chamber 14 is charged to a high pressure with fuel from a suitable fuel source, for example in the form of a common rail charged to a suitably high pressure by an appropriate high pressure fuel pump. The position of the outer valve needle 12 is controlled using an appropriate control arrangement, for example in the form of a piezoelectric actuator arrangement. In the position illustrated, the outer valve needle 12 is urged by the control arrangement into engagement with the seating surface 13. As a result, fuel from the delivery chamber 14 is unable to flow to the outlet openings, and fuel injection is not taking place. When fuel injection is to commence, the actuator is operated to allow the outer valve needle 12 to lift away from the seating surface 13. As a result, fuel from the delivery chamber 14 is able to flow to the first outlet opening 15 and through the first outlet opening 15 to a combustion space with which the injector is associated. Provided the distance through which the outer valve needle 12 is lifted from the seating surface 13 is sufficiently small that the shoulder defined by the inner end of the sleeve 18 remains spaced from the enlarged head 17*a* of the inner valve needle 17, then the inner valve needle 17 will remain in engagement with the seating surface 13, and so fuel is unable to flow to the second outlet opening 19. Under these conditions, fuel injection occurs through the first outlet opening 15 only.

A small clearance is defined between the inner valve needle 17 and the sleeve 18, thus fuel is able to flow to a chamber defined adjacent the blind end of the bore 16, pressurizing this chamber and hence applying a force to the inner valve needle 17 urging the inner valve needle 17 into engagement with the seating surface 13. As a result, the inner valve needle 17 will remain in engagement with the seating surface 13 provided the outer valve needle 12 remains in a position in which it is only spaced from the seating surface 13 by a small amount.

Where injection is required at a higher rate, the outer valve needle 12 is moved, under the control of the actuator arrangement, through a sufficiently large distance to cause the shoulder to move into engagement with the enlarged head 17*a* of the inner valve needle 17 and to cause the inner valve needle 17 to move with the outer valve needle 12 such that both valve needles 12, 17 are spaced from the seating surface 13. Under such conditions, fuel from the delivery chamber 14 is able to flow to both the first and second outlet openings 15, 19. The flow of fuel through the outlet openings 15, 19 is in the form of sprays which, due to the orientation of the axes of the first and second outlet openings 15, 19, intersect and interfere with one another at the point 20, forming a single spray formation which behaves as if it were produced from an outlet opening of diameter or area greater than that of the first outlet opening 15.

In order to terminate injection, the outer valve needle 12 is returned to the position illustrated in which it engages the seating surface 13. In this position, fuel is unable to flow to either of the outlet openings, thus injection of fuel is terminated.

It will be appreciated that both where the outer valve needle 12 is spaced from the seating surface 13 by a small distance and where it is spaced from the seating surface 13 by a relatively large distance, the injector operates as if fuel is being delivered through a single outlet opening, the fuel being delivered either solely through the first outlet opening 15 or the delivery of fuel through both the first and second outlet openings 15, 19 combining to form a single spray formation which behaves as if it were produced from a single outlet opening. This provides a variable outlet opening size effect to enable the fuel injection rate to be varied.

Figure 3:
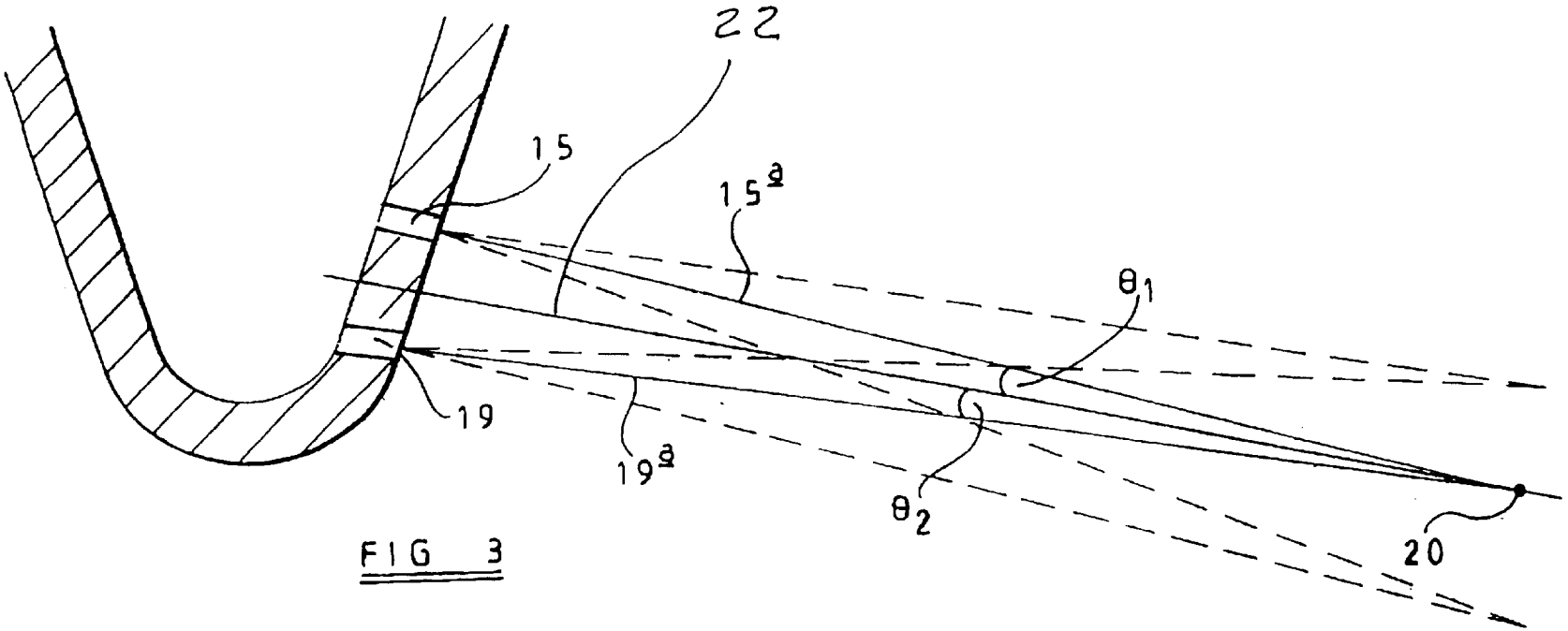
FIG. 3 is a view of an end region of the nozzle body forming part of the injector in FIG. 2 to illustrate the fuel sprays from first and second openings formed in the nozzle body.

Referring to FIGS. 2 and 3, the axis 22 represents the axis of the combined spray formation which behaves as if it were produced from a single outlet opening when fuel is delivered through both the first and second outlet openings 15, 19. The angles, $\theta_1$ and $\theta_2$, represent the angles between the axis 22 and the axes 15*a*, 19*a* of the first and second outlet openings 15, 19 respectively. The distance, D, along the axis 22 between the first and second outlet openings 15, 19 and the point 20 at which the fuel sprays intersect is preferably approximately half the distance 2D between the first and second outlet openings 15, 19 and the wall 24 of the combustion chamber into which fuel is injected. In order to ensure satisfactory merging of the sprays from the first and second outlet openings 15, 19, the angles $\theta_1$ and $\theta_2$, preferably have values within the following ranges;

$$\theta_1=+7.5^\circ \text{ to } -7.5^\circ \qquad \text{Equation 1(a)}$$

$$\text{and } \theta_2=+7.5^\circ \text{ to } -7.5^\circ \qquad \text{Equation 1(b)}$$

Or, expressed alternatively;

$$\theta_1-\theta_2=+7.5^\circ \text{ to } -7.5^\circ \qquad \text{Equation (2)}$$

With reference to Equation (2), $\theta_1-\theta_2$ represents the difference in angle between the axis 15*a* of the first outlet opening 15 and the axis 19*a* of the second outlet opening.

It has been found that by arranging the axes 15*a*, 19*a*, 22 as described above, optimum emission levels and combustion noise levels are achieved over a range of engine speeds and loads. It will be appreciated, however, that the angles $\theta_1$ and $\theta_2$ may take values falling outside of the ranges stated in Equations 1(a) and 1(b) and the value, $\theta_1-\theta_2$, may take a value falling outside the range stated in Equation (2).

Figure 4:
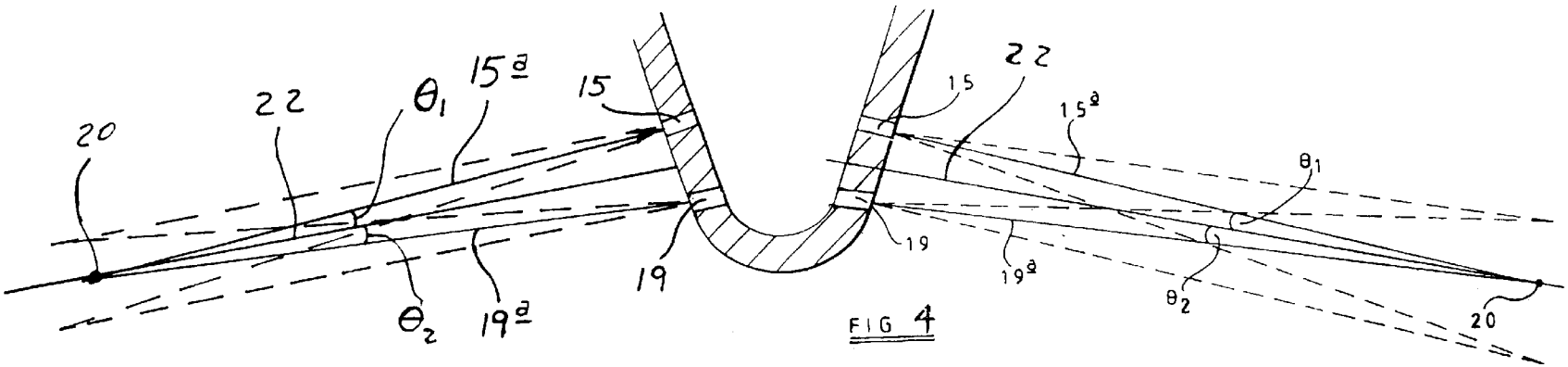
FIG. 4 is a view of an end region of the nozzle body similar to the end region of FIG. 3 and also incorporating an additional set of fuel sprays from multiple sets of first and second openings formed in the nozzle body.

Although in the embodiment illustrated, only a single first outlet opening 15 and a single second outlet opening 19 are provided, it will be appreciated that further pairs of outlet openings 15, 19 could be provided, if desired as illustrated in FIG. 4. Further, one or more additional first or second outlet openings 15, 19 may be provided which are not associated with other outlet openings. Thus, the outlet openings of the injector may be arranged such that the injector can deliver one or more combined spray formation, or may deliver a combined spray formation and a spray formation from a single, further outlet opening which does not combine with a spray formation from any other outlet opening.

It will be appreciated that the invention is applicable to injectors of design other than that illustrated, in which suitable means are provided to control the number of outlet openings through which fuel is delivered. Where injectors of the type including an outer valve needle and an inner valve needle are used, it will be appreciated that alternative techniques may be used to cause the inner valve needle to move than the particular example described.

It will further be appreciated that the fuel injector need not include an inner needle and an outer needle, but may comprise an alternative valve needle arrangement which permits fuel delivery either through a first outlet opening (or set of first outlet openings) alone or through both a first and second outlet opening so as to permit the fuel sprays from each of the first and second outlet openings to combine so as to form a single spray formation which behaves as if it were produced from a single outlet opening.

By appropriate selection of the orientation of the axes 15*a*, 19*a* of the first and second outlet openings 15, 19, an optimum combined spray orientation may be achieved both where fuel is delivered only through the first outlet opening 15 and where fuel is being delivered through both the first and second outlet openings 15, 19.

We claim:

1. A fuel injection system comprising a fuel injector and a combustion cylinder for use in an internal combustion engine cylinder, the injector comprising a nozzle body, a first outlet opening having an axis, a second outlet opening having an axis, an arrangement for controlling fuel delivery through the first and second outlet openings, wherein the first and second outlet openings being a first distance from a wall of the cylinder, the axes of the first and second outlet openings are selectively angled to intersect one another downstream of the outlet openings such that the axes intersect approximately at a distance one half of the first distance such that, when fuel is delivered through both the first and second outlet openings, a combined spray formation is formed which is substantially equivalent to a single spray formation having been delivered from a single opening, wherein the arrangement for controlling fuel delivery through the first and second outlet openings is arranged to selectively permit fuel delivery from only one of the outlet openings.

2. The fuel injector as claimed in claim 1, the first and second outlet openings being arranged so as to give rise to the combined spray formation which is substantially equivalent to a single spray formation having been delivered from an outlet opening having a diameter greater than that of the first outlet opening.

3. The fuel injector as claimed in claim 1, wherein the combined spray formation has an associated axis, the angle between the axis of the first outlet opening and the axis of the combined spray formation having a value between +7.5° and −75°.

4. The fuel injector as claimed in claim 1, wherein the combined spray formation has an associated axis, the angle between the axis of the second outlet opening and the axis of the combined spray formation having a value between +7.5° and −7.5°.

5. The fuel injector as claimed in claim 1, wherein the first and second openings open into a bore provided in the nozzle body at axially spaced positions.

6. The fuel injector as claimed in claim 1, wherein the arrangement for controlling fuel delivery through the first and second outlet openings comprise an outer needle slidable within the bore to control fuel delivery through the first outlet opening and an inner needle slidable within a bore formed in the outer needle to control fuel delivery through the second outlet opening.

7. The fuel injector as claimed in claim 1, comprising one or more additional pairs of first and second outlet openings.

8. A fuel injection system comprising a fuel injector and a combustion cylinder for use in an internal combustion engine cylinder, the injector comprising a nozzle body, a first outlet opening having an axis, a second outlet opening having an axis, an arrangement for controlling fuel delivery through the first and second outlet openings, wherein the first and second outlet openings being a first distance from a wall of the cylinder, the axes of the first and second outlet openings are selectively angled to intersect one another downstream of the outlet openings such that the axes intersect approximately at a distance of one half of the first distance such that, when fuel is delivered through both the first and second outlet openings, a combined spray formation is formed which is substantially equivalent to a single spray formation having been delivered from a single opening, wherein the arrangement for controlling fuel delivery through the first and second outlet openings is arranged to permit fuel delivery from only one of the outlet openings and comprises an outer needle slidable within the bore to control fuel delivery through the first outlet opening and an inner needle slidable within a bore formed in the outer needle to control fuel delivery through the second outlet opening and further comprising a load transmitting arrangement to permit the outer needle to transmit a force to the inner needle so as to cause movement of the inner needle when the outer needle is moved beyond a predetermined amount.

9. The fuel injector as claimed in claim 8 wherein the load transmitting arrangement takes the form of a sleeve arranged within the bore, the sleeve defining a shoulder which is engageable with a surface of the inner needle to cause movement thereof when the outer needle is moved beyond the predetermined amount.

10. A fuel injection system including an injector and a combustion cylinder, the combustion cylinder having a cylinder wall and the injector having first and second outlet openings, a nozzle body and an arrangement for controlling fuel delivery through the first and second outlet openings, the first outlet opening having a first axis and the second outlet opening having a second axis, and wherein the injector is placed so that the first and second outlet openings are at a first distance from said cylinder wall, the arrangement for controlling fuel delivery through the first and second outlet openings is arranged to permit fuel delivery either through both the first and second outlet openings together or through one of the outlet openings on its own, and the axes of the first and second outlet openings are selectively angled to intersect at a point of intersection such that, when fuel is delivered through both the first and second outlet openings together, a combined spray formation is formed that is substantially equivalent to a single spray having been delivered along a third axis from a single outlet opening, said first and second axes being selected so that said point of intersection is at approximately half the first distance along the third axis.

11. A method of operating a fuel injector for varying the rate at which fuel is injected by the fuel injector, the fuel injector having a nozzle body, a first outlet opening having a first axis, a second outlet opening having a second axis, and an arrangement for controlling fuel delivery through the first and second outlet openings, the first axis and the second axis being angled such that the first axis and the second axis intersect at a distance away from the nozzle body such that fuel delivered through both the first and second outlet openings form a combined spray formation substantially equivalent to a single spray formation having been delivered from a single opening, the method comprising:

selectively controlling the arrangement for injecting fuel through only one of the first and second outlet openings to achieve a first fuel injection rate; and, selectively controlling the arrangement for injecting fuel through both of the first and second outlet openings to achieve a second fuel injection rate.

12. A method of operating a fuel injector for varying the rate at which fuel is injected by the fuel injector, the fuel injector having a nozzle body, a first outlet opening having a first axis, a second outlet opening having a second axis, and an arrangement for controlling fuel delivery through the first and second outlet openings, the first axis and the second axis being angled such that the first axis and the second axis intersect at a distance away from the nozzle body such that fuel delivered through both the first and second outlet openings form a combined spray formation substantially equivalent to a single spray formation having been delivered from a single opening, the method including the step of selectively controlling the arrangement for injecting fuel through one of (1) only one of the first and second outlet openings to achieve a first fuel injection rate and (2) both of the first and second outlet openings to achieve a second fuel injection rate.

* * * * *